US012545850B2

(12) United States Patent
Nakaue et al.

(10) Patent No.: US 12,545,850 B2
(45) Date of Patent: Feb. 10, 2026

(54) LUBRICATING OIL COMPOSITION

(71) Applicant: IDEMITSU KOSAN CO., LTD., Tokyo (JP)

(72) Inventors: Daisuke Nakaue, Tokyo (JP); Masaya Kubota, Tokyo (JP)

(73) Assignee: IDEMITSU KOSAN CO., LTD., Tokyo (JP)

( * ) Notice: Subject to any disclaimer, the term of this patent is extended or adjusted under 35 U.S.C. 154(b) by 0 days.

(21) Appl. No.: 18/727,508

(22) PCT Filed: Mar. 14, 2023

(86) PCT No.: PCT/JP2023/009819
§ 371 (c)(1),
(2) Date: Jul. 9, 2024

(87) PCT Pub. No.: WO2023/182073
PCT Pub. Date: Sep. 28, 2023

(65) Prior Publication Data

US 2025/0084339 A1 Mar. 13, 2025

(30) Foreign Application Priority Data

Mar. 24, 2022 (JP) ..... 2022-048868

(51) Int. Cl.

| | |
|---|---|
| ***C10M 171/04*** | (2006.01) |
| ***C10M 159/00*** | (2006.01) |
| ***C10M 169/04*** | (2006.01) |
| *C10N 20/02* | (2006.01) |
| *C10N 30/00* | (2006.01) |
| *C10N 40/25* | (2006.01) |

(52) U.S. Cl.
CPC ..... *C10M 171/04* (2013.01); *C10M 159/005* (2013.01); *C10M 169/041* (2013.01); *C10M 169/042* (2013.01); *C10N 2020/02* (2013.01); *C10N 2030/43* (2020.05); *C10N 2030/45* (2020.05); *C10N 2030/68* (2020.05); *C10N 2040/252* (2020.05)

(58) Field of Classification Search
CPC ..... C10N 2030/45; C10N 2020/02; C10N 2040/252; C10N 2030/43; C10N 2030/68
See application file for complete search history.

(56) References Cited

U.S. PATENT DOCUMENTS

2017/0298287 A1* 10/2017 Tamura ..... C10M 163/00
2018/0030368 A1 2/2018 Oh

FOREIGN PATENT DOCUMENTS

| | | | | |
|---|---|---|---|---|
| JP | 2008-546894 | A | | 12/2008 |
| JP | 2019094473 | A | * | 6/2019 |
| JP | 2019-532134 | A | | 11/2019 |
| JP | 2021-101009 | A | | 7/2021 |
| JP | 2022-41875 | A | | 3/2022 |
| WO | WO 2007/003238 | A1 | | 1/2007 |
| WO | WO 2016/043333 | A1 | | 3/2016 |
| WO | WO 2018/041755 | A1 | | 3/2018 |

OTHER PUBLICATIONS

International Search Report issued May 30, 2023 in PCT/JP2023/009819, filed on Mar. 14, 2023, 2 pages.

* cited by examiner

*Primary Examiner* — Vishal V Vasisth
(74) *Attorney, Agent, or Firm* — Oblon, McClelland, Maier & Neustadt, L.L.P.

(57) ABSTRACT

A lubricating oil composition may have excellent fuel economy and high shear stability. Such a lubricating oil composition may include: a comb-like polymer (A1) having a weight average molecular weight (Mw) of less than 300,000; and a comb-like polymer (A2) having a Mw of at least 400,000. The (A1)/(A2) mass content ratio of the comb-like polymer (A1) to the comb-like polymer (A2) in terms of resin content may be at least 0.25.

14 Claims, No Drawings

LUBRICATING OIL COMPOSITION

CROSS-REFERENCE TO RELATED APPLICATIONS

The present application is the national stage of international application PCT/JP2023/009819, filed on Mar. 14, 2023, and claims the benefit of the filing date of Japanese Appl. No. 2022-048868, filed on Mar. 24, 2022.

TECHNICAL FIELD

The present invention relates to a lubricating oil composition, a diesel engine, and a method for using the lubricating oil composition.

BACKGROUND ART

In recent years, global-scale environmental regulations have become increasingly severe, and situations surrounding automobiles also have steadily become severe in aspects of fuel consumption regulations, exhaust gas regulations and the like. In particular, the improvement in the fuel consumption performance of vehicles such as automobiles is a large problem, and as one means to solve the problem, the improvement in the fuel consumption saving performance of lubricating oil compositions to be used in the vehicles has been demanded.

For the improvement in the fuel consumption saving performance of lubricating oil compositions, a methacrylate (PMA) is usually used as a viscosity index improver to be blended in lubricating oil compositions.

It is known that use under the condition of high temperatures and high shear of lubricating oil compositions containing a viscosity index improver such as PMA brings about a decrease in the cleanliness. Then, Patent Literature 1, aiming at providing a lubricating oil composition having excellent cleanliness, fuel consumption saving performance and the like, describes a lubricating oil composition containing a comb polymer of 420,000 to 450,000 in weight-average molecular weight in its examples.

CITATION LIST

Patent Literature

Patent Literature 1: International Publication No. WO 2016/043333

SUMMARY OF INVENTION

Technical Problem

In such a situation, a lubricating oil composition is demanded which is more improved in the fuel consumption saving performance and can simultaneously be applied more suitably to internal combustion engines.

The present invention has been achieved in consideration of the above, and has an object to provide a lubricating oil composition having excellent fuel consumption saving performance and high shear stability, and a method for using the lubricating oil composition.

Solution to Problem

As a result of exhaustive studies, the present inventors have found that by using comb polymers of two kinds having different weight-average molecular weights and adjusting these at a mass ratio in a specific range, the above problem can be solved, and have completed the present invention.

That is, the present invention provides the following aspects [1] to [11].

[1] A lubricating oil composition comprising a base oil, a comb polymer (A1) having a weight-average molecular weight (Mw) of less than 300,000 and a comb polymer (A2) having a Mw of 400,000 or more, wherein a content ratio [(A1)/(A2)] in terms of resin content mass ratio between the comb polymer (A1) and the comb polymer (A2) is 0.25 or more.

[2] The lubricating oil composition according to [1], wherein a content of the comb polymer (A1) in terms of resin content is 0.01 to 3.50 mass % based on the total amount of the lubricating oil composition.

[3] The lubricating oil composition according to [1] or [2], wherein a content of the comb polymer (A2) in terms of resin content is 0.01 to 2.40 mass % based on the total amount of the lubricating oil composition.

[4] The lubricating oil composition according to any one of [1] to [3], wherein the lubricating oil composition has a kinematic viscosity at 100° C. of 9.3 $mm^2/s$ or more.

[5] The lubricating oil composition according to any one of [1] to [4], wherein the lubricating oil composition has a high-temperature high-shear viscosity (HTHS viscosity) at 150° C. of 2.9 mPa·s or more.

[6] The lubricating oil composition according to any one of [1] to [5], wherein the lubricating oil composition has a kinematic viscosity at 40° C. of 38.0 $mm^2/s$ or less.

[7] The lubricating oil composition according to any one of [1] to [6], wherein the lubricating oil composition after being passed through a 30-cycle high-shear Bosch diesel injector has a kinematic viscosity at 100° C. of 8.6 $mm^2/s$ or more as based on ASTM D6278.

[8] The lubricating oil composition according to any one of [1] to [7], wherein the lubricating oil composition has a sulfuric ash content of 0.90 mass % or less.

[9] The lubricating oil composition according to any one of [1] to [8], wherein the lubricating oil composition is used in a diesel engine.

[10] A diesel engine, comprising the lubricating oil composition according to any one of [1] to [9] filled therein.

[11] A method for using a lubricating oil composition, wherein the lubricating oil composition according to any one of [1] to [10] is applied to lubrication of a diesel engine.

Advantageous Effects of Invention

The suitable lubricating oil composition according to one aspect of the present invention has excellent fuel consumption saving performance and high shear stability.

DESCRIPTION OF EMBODIMENTS

With regard to numerical value ranges described in the present description, an upper limit value and a lower limit value can optionally be paired. For example, in the case where there is a description of "preferably 30 to 100, more preferably 40 to 80" as a numerical value range, a range of "30 to 80" and a range of "40 to 100" also are included in the numerical value range described in the present description. Further, for example, in the case where there is a description of "preferably 30 or more, more preferably 40 or more and preferably 100 or less, more preferably 80 or less", as a numerical value range described in the present description, a range of "30 to 80" and a range of "40 to 100" also are included in the numerical value range described in the present description.

Additionally, for example, a description of "60 to 100" as a numerical value range described in the present description means a range of "60 or more and 100 or less".

Further, in a prescription of an upper limit value and a lower limit value described in the present description, the numerical value range of from a lower limit value to an upper limit value can be prescribed by suitably selecting and optionally pairing the lower limit value and the upper limit value from among respective options.

Additionally, a plurality of various requirements to be described as preferred embodiments in the present description can be combined.

[Constitution of the Lubricating Oil Composition]

The lubricating oil composition of the present invention comprises a comb polymer (A1) of less than 300,000 in weight-average molecular weight (Mw) and a comb polymer (A2) of 400,000 or more in Mw, wherein the content ratio [(A1)/(A2)] in terms of resin content mass ratio between the comb polymer (A1) and the comb polymer (A2) is 0.25 or more.

In order to provide lubricating oil compositions excellent in the fuel consumption saving performance, a viscosity index improver having a relatively high weight-average molecular weight is usually used. Thereby, the 100° C. kinematic viscosity, the 40° C. kinematic viscosity and the high-temperature high-shear viscosity (HTHS viscosity) being indices of the fuel consumption saving performance can be adjusted at reference values or below.

In order to meet the standards (DL-1, DL-2) of diesel engine oils, however, in addition to the fuel consumption saving performance, it is needed to have high shear stability. Nevertheless, it is difficult for the high shear stability to be achieved only by a viscosity index improver having a relatively high weight-average molecular weight, and it is difficult for both the excellent fuel consumption saving performance and the high shear stability to be acquired simultaneously.

Then, even if by a viscosity index improver such as PMA usually used, the 100° C. kinematic viscosity and the HTHS viscosity can meet reference values and the high shear stability can be achieved, it is difficult to adjust the value of 40° C. kinematic viscosity within reference values.

The present inventors have found that in order to solve such a problem, by blending a comb polymer having a relatively low weight-average molecular weight to a comb polymer having a relatively high weight-average molecular weight, a lubricating oil composition meeting the above various parameters can be made, and this finding has led to the completion of the present invention.

Hereinafter, the detail of each component contained in a lubricating oil composition according to one embodiment of the present invention will be described.

<Base Oil>

A base oil contained in the lubricating oil composition according to one embodiment of the present invention may be a mineral oil, may be a synthetic oil, or may be a mixed oil of a mineral oil and a synthetic oil.

Examples of the mineral oil include atmospheric residual oil obtained by atmospherically distilling crude oil such as paraffinic crude, intermediate-base crude or naphthenic crude; distillate oil obtained by vacuum distilling these atmospheric residual oils; refined oil obtained by subjecting the distillate oil to one or more refining treatments of solvent deasphalting, solvent extraction, hydrocracking, solvent dewaxing, catalytic dewaxing, hydrotreating and the like; and the like.

Examples of the synthetic oil include poly-α-olefins such as α-olefins and homopolymers thereof, α-olefin copolymers (for example, α-olefin copolymers having 8 to 14 carbon atoms, such as ethylene-α-olefin copolymers); isoparaffin; polyalkylene glycol; ester oils such as polyol esters, dibasic acid esters and phosphate esters; ether oils such as polyphenyl ethers; alkylbenzenes; alkylnaphthalenes; and synthetic oils (GTL) obtained by isomerizing waxes (GTL waxes (Gas To Liquids WAX)) produced from natural gas by the Fischer-Tropsch process.

Among these, the base oil to be used in one embodiment of the present invention preferably contains at least one selected from mineral oils and synthetic oils classified into Group 2 and Group 3 in the API (American Petroleum Institute) base oil category. In one embodiment of the present invention, these base oils may be used singly in one kind, or may be used concurrently in two or more kinds.

The kinematic viscosity at 100° C. of the base oil to be used in one embodiment of the present invention is preferably 4.1 $mm^2/s$ or more, more preferably 4.2 $mm^2/s$ or more and still more preferably 4.3 $mm^2/s$ or more, and preferably 4.5 $mm^2/s$ or less and more preferably 4.4 $mm^2/s$ or less. When the kinematic viscosity at 100° C. of the base oil is 4.1 $mm^2/s$ or more, it is preferable for retaining oil films. On the other hand, when the kinematic viscosity at 100° C. of the base oil is 4.5 $mm^2/s$ or less, it is preferable because the power loss by the viscous resistance can be suppressed and the fuel consumption improving effect can be attained.

The viscosity index of the base oil to be used in one embodiment of the present invention is, from the viewpoint of suppressing the viscosity change by the temperature change, and improving the fuel consumption saving performance, preferably 70 or more, more preferably 80 or more, still more preferably 90 or more and further still more preferably 100 or more.

In the present description, the kinematic viscosity and the viscosity index mean values measured or calculated according to ASTM D455.

In the lubricating oil composition according to one embodiment of the present invention, the content of the base oil is, based on the total amount (100 mass %) of the lubricating oil composition, usually 55 mass % or more, preferably 60 mass& or more, more preferably 65 mass % or more, still more preferably 70 mass % or more, further still more preferably 75 mass % or more and especially preferably 80 mass % or more, and then preferably 99.9 mass % or less, more preferably 98 mass % or less and still more preferably 95 mass % or less.

<Viscosity Index Improver>

The lubricating oil composition of the present invention comprises the comb polymer (A1) of less than 300,000 in weight-average molecular weight (Mw) and the comb polymer (A2) of 400,000 or more in Mw. The comb polymers (A1) and (A2) suffice if being polymers having a structure having, on a main chain, a large number of three-way branch points from which high-molecular weight side chains extend.

The comb polymers (A1) and (A2) to be used in one embodiment of the present invention are preferably polymers having at least a constitutional unit (X1) derived from a macromonomer (x1). The constitutional unit (X1) corresponds to the above-mentioned "high-molecular weight side chain".

Then, in the present invention, the "macromonomer (x1)" means a high-molecular weight monomer having a polymerizable functional group, and is preferably a high-molecular weight monomer having the polymerizable functional group on the terminal.

The number-average molecular weight (Mn) of the macromonomer (x1) is preferably 300 or more, more preferably 400 or more and still more preferably 500 or more, and then preferably 100,000 or less, more preferably 50,000 or less and still more preferably 20,000 or less.

The comb polymers (A1) and (A2) to be used in one embodiment of the present invention each may be a homopolymer composed only of a constitutional unit (X1) derived from one kind of macromonomer (x1), or may be a copolymer containing a constitutional unit (X1) derived from two or more kinds of macromonomer (x1).

Further, the comb polymers (A1) and (A2) to be used in one embodiment of the present invention each may be a copolymer containing, together with the constitutional unit derived from the macromonomer (x1), a constitutional unit (X2) derived from another monomer other than the macromonomer (x1).

With regard to the specific structure of such a comb polymer, a copolymer is preferable in which side chains containing the constitutional unit (X1) derived from the macromonomer (x1) are on a main chain containing the constitutional unit (X2) derived from a monomer (x2).

Examples of the monomer (x2) include alkyl (meth) acrylates, nitrogen atom-containing vinyl monomers, hydroxide group-containing vinyl monomers, phosphorus atom-containing monomers, aliphatic hydrocarbon vinyl monomers, alicyclic hydrocarbon vinyl monomers, vinyl esters, vinyl ketones, epoxy group-containing vinyl monomers, halogen element-containing vinyl monomers, esters of unsaturated polycarboxylic acids, (di)alkyl fumarates, (di) alkyl maleates and aromatic hydrocarbon vinyl monomers.

In the lubricating oil composition of the present invention, by making the content ratio in terms of resin content of the comb polymer (A1) and the comb polymer (A2) in a specific numerical value range, the above problem is solved. By adjusting the content ratio in terms of resin content of these comb polymers, the lubricating oil composition can be made one having excellent fuel consumption saving performance and high shear stability.

In the lubricating oil composition of the present invention, the content ratio [(A1)/(A2)] in terms of resin content of the comb polymer (A1) and the comb polymer (A2) is, from the above viewpoint, preferably 0.25 or more, more preferably 0.26 or more, still more preferably 0.27 or more and especially preferably 0.28 or more, and then preferably 0.55 or less, more preferably 0.54 or less, still more preferably 0.53 or less, further still more preferably 0.52 or less, further still more preferably 0.51 or less, further still more preferably 0.50 or less, further still more preferably 0.49 or less, further still more preferably 0.48 or less, further still more preferably 0.47 or less, further still more preferably 0.46 or less and especially preferably 0.45 or less.

Then, the weight-average molecular weight (Mw) of the comb polymer (A1) to be used in one embodiment of the present invention is, from the viewpoint of providing high shear stability, preferably less than 300,000, more preferably 300,000 or less, still more preferably 290,000 or less, further still more preferably 280,000 or less and further still more preferably 270,000 or less, and from the viewpoint of enhancing the fuel consumption saving performance, preferably 50,000 or more, more preferably 100,000 or more, still more preferably 120,000 or more, further still more preferably 150,000 or more, further still more preferably 170,000 or more and especially preferably 200,000 or more.

The weight-average molecular weight (Mw) of the comb polymer (A2) to be used in one embodiment of the present invention is, from the viewpoint of enhancing the fuel consumption saving performance, preferably 400,000 or more, more preferably 410,000 or more, still more preferably 420,000 or more, further still more preferably 430,000 or more, further still more preferably 440,000 or more and especially preferably 450,000 or more, and is, from the viewpoint of enhancing the shear stability, preferably 900,000 or less, more preferably 800,000 or less, still more preferably 700,000 or less, further still more preferably 600,000 or less, further still more preferably 550,000 or less and especially preferably 500,000 or less.

In the present description, the weight-average molecular weight (Mw) and the number-average molecular weight (Mn) are values in terms of standard polystyrenes measured by gel permeation chromatography (GPC), and specifically, values in terms of standard polystyrenes measured by the following measurement device and under the following measurement condition.

(Measurement Device)

A gel permeation chromatography device ("1260-type HPLC", manufactured by Agilent Technologies, Inc.)

(Measurement Condition)

Column: two columns of "Shodex LF404" successively connected

Column temperature: 35° C.

Development solvent: chloroform

Flow rate: 0.3 mL/min

In the lubricating oil composition according to one embodiment of the present invention, the difference between the Mw of the comb polymer (A2) and the Mw of the comb polymer (A1) is, from the viewpoint of making easy the regulation of parameters being indices of the fuel consumption saving performance and the shear stability by using comb polymers having different SSIs (shear stability indices), preferably 50,000 or larger, more preferably 70,000 or larger, still more preferably 90,000 or larger, further still more preferably 100,000 or larger, further still more preferably 110,000 or larger, further still more preferably 120,000 or larger, further still more preferably 130,000 or larger, further still more preferably 140,000 or larger, further still more preferably 150,000 or larger, further still more preferably 160,000 or larger, further still more preferably 170,000 or larger, further still more preferably 180,000 or larger and especially preferably 190,000 or larger.

Then from the viewpoint similar to the above, the difference between the Mw of the comb polymer (A2) and the Mw of the comb polymer (A1) is preferably 900,000 or less, more preferably 800,000 or less, still more preferably 700,000 or less, further still more preferably 600,000 or less, further still more preferably 500,000 or less, further still more preferably 450,000 or less, further still more preferably 400,000 or less, further still more preferably 350,000 or less and especially preferably 300,000 or less.

Then, in this case, the Mw of the comb polymer (A2) is, from the viewpoint of enhancing the fuel consumption saving performance, preferably at least 400,000 or more.

The molecular weight distribution (Mw/Mn) (Mw: weight-average molecular weight of the comb polymer (A1), Mn: number-average molecular weight of the comb polymer (A1)) of the comb polymer (A1) to be used in one embodiment of the present invention is preferably 7.00 or less, more preferably 6.00 or less, still more preferably 5.00 or less, further still more preferably 4.00 or less and especially preferably 3.50 or less, and then usually 1.01 or more, preferably 1.05 or more and more preferably 1.10 or more.

The molecular weight distribution (Mw/Mn) (Mw: weight-average molecular weight of the comb polymer (A2), Mn: number-average molecular weight of the comb polymer (A2)) of the comb polymer (A2) to be used in one embodiment of the present invention is preferably 8.00 or less, more preferably 7.50 or less, still more preferably 7.00 or less, further still more preferably 6.50 or less and especially preferably 6.00 or less, and then usually 1.01 or more, preferably 1.05 or more and more preferably 1.10 or more.

Then, in the lubricating oil composition according to one embodiment of the present invention, the content of the comb polymer (A1) in terms of resin content is, from the viewpoint of providing high shear stability, based on the total amount (100 mass %) of the lubricating oil composition, preferably 0.01 mass % or more, more preferably 0.05 mass % or more, still more preferably 0.10 mass % or more, further still more preferably 0.20 mass % or more, further still more preferably 0.25 mass % or more, further still more preferably 0.30 mass % or more, further still more preferably 0.35 mass % or more, further still more preferably 0.40 mass % or more, further still more preferably 0.45 mass % or more, further still more preferably 0.50 mass& or more and especially preferably 0.55 mass % or more.

On the other hand, from the viewpoint of making the lubricating oil composition to be one having good fuel consumption saving performance, the content of the comb polymer (A1) in terms of resin content is, based on the total amount (100 mass %) of the lubricating oil composition, preferably 3.50 mass % or less, more preferably 3.00 mass % or less, still more preferably 2.50 mass % or less, further still more preferably 2.00 mass % or less, further still more preferably 1.50 mass % or less, further still more preferably 1.25 mass % or less, further still more preferably 1.20 mass& or less, further still more preferably 1.15 mass % or less, further still more preferably 1.10 mass % or less, further still more preferably 1.05 mass % or less, further still more preferably 1.00 mass % or less, further still more preferably 0.95 mass % or less and especially preferably 0.90 mass % or less.

On the other hand, in the lubricating oil composition according to one embodiment of the present invention, the content of the comb polymer (A2) in terms of resin content is, from the viewpoint of enhancing the fuel consumption saving performance, based on the total amount (100 mass %) of the lubricating oil composition, preferably 0.01 mass % or more, more preferably 0.05 mass % or more, still more preferably 0.10 mass % or more, further still more preferably 0.30 mass % or more, further still more preferably 0.50 mass % or more, further still more preferably 0.70 mass % or more, further still more preferably 0.90 mass % or more, further still more preferably 1.00 masse or more, further still more preferably 1.10 mass % or more, further still more preferably 1.20 mass % or more, further still more preferably 1.30 mass % or more, further still more preferably 1.40 mass % or more, further still more preferably 1.50 mass % or more, further still more preferably 1.55 mass % or more, further still more preferably 1.60 mass % or more, further still more preferably 1.65 mass % or more, further still more preferably 1.70 mass % or more, further still more preferably 1.75 mass % or more, further still more preferably 1.80 mass % or more and especially preferably 1.85 mass % or more.

On the other hand, from the viewpoint of making the lubricating oil composition to be one having good shear stability, the content of the comb polymer (A2) in terms of resin content is, based on the total amount (100 mass %) of the lubricating oil composition, preferably 2.40 mass % or less, more preferably 2.35 mass % or less, still more preferably 2.30 mass % or less, further still more preferably 2.25 mass % or less, further still more preferably 2.20 mass % or less, further still more preferably 2.15 mass % or less, further still more preferably 2.10 mass % or less and especially preferably 2.05 mass % or less.

In the lubricating oil composition according to one embodiment of the present invention, the total content of the comb polymer (A1) and the comb polymer (A2) is, based on the total amount (100 mass %) of the lubricating oil composition, preferably 2.00 mass % or more, more preferably 2.10 mass % or more, still more preferably 2.15 mass % or more, further still more preferably 2.20 mass % or more, further still more preferably 2.25 mass % or more, further still more preferably 2.30 mass % or more, further still more preferably 2.35 mass % or more and especially preferably 2.40 mass % or more, and then preferably 3.00 mass % or less, more preferably 2.95 mass % or less, still more preferably 2.90 mass % or less, further still more preferably 2.85 mass % or less, further still more preferably 2.80 mass % or less and especially preferably 2.75 mass % or less.

Here, viscosity index improvers such as the comb polymers (A1) and (A2) are distributed, in consideration of the handleability and the dissolvability thereof into base oils, in forms of solutions in which the viscosity index improvers are dissolved in a diluting oil such as a mineral oil, a synthetic oil or a light oil; and in the preparation of the lubricating oil compositions, there are some cases where the viscosity index improvers are blended in the forms of the solutions containing the diluting oil.

In the present description, however, the content of the viscosity index improver is a "content in terms of resin content" as described above, and means a content of resin content excluding the diluting oil.

Here, the value of SSI of the viscosity index improver is a physical property value indicating, in percentage, a decrease in the viscosity by shear derived from a polymer constituting the viscosity index improver. That is, the value of SSI indicates a capability of the polymer to resist shear, and it can be said that the higher the value of SSI, the polymer is more unstable to shear and more easily decomposed.

The SSI of the comb polymer (A1) to be used in one embodiment of the present invention is preferably 7.0 or less, more preferably 6.0 or less, still more preferably 5.0 or less, further still more preferably 4.0 or less and especially preferably 3.0 or less, and then preferably 0.1 or more, more preferably 0.5 or more and still more preferably 0.7 or more.

The SSI of the comb polymer (A2) to be used in one embodiment of the present invention is preferably 12.0 or less, more preferably 11.0 or less and still more preferably 10.0 or less, and then preferably 7.0 or more and more preferably 8.0 or more.

The SSI as a mixture of the comb polymers (A1) and (A2) is preferably 10.0 or less, more preferably 9.0 or less and still more preferably 8.0 or less, and then preferably 0.1 or more, more preferably 0.5 or more, still more preferably 1.0 or more, further still more preferably 2.0 or more and further still more preferably 5.0 or more.

Then, in one embodiment of the present invention, in the case where a viscosity index improver other than the comb polymers (A1) and (A2) is concurrently used, the SSI of the viscosity index improver is, as the SSI of the mixture, preferably in the above range.

Then, in the present description, the SSI of the viscosity index improver means a value measured according to ASTM D6278, and more specifically, is a value calculated by the following calculation expression (1):

[Math. 1]

$$SSI = \frac{Kv_0 - Kv_1}{Kv_0 - Kv_{oil}} \times 100 \quad (1)$$

wherein $Kv_0$ is a value of the kinematic viscosity at 100° C. of a sample oil of a viscosity index improver to be measured diluted with a mineral oil; and $Kv_1$ is a value of the kinematic viscosity at 100° C. of the sample oil in which the viscosity index improver is diluted with the mineral oil after being passed through a 30-cycle high-shear Bosch diesel injector according to the procedure of ASTM D6278. $Kv_{oil}$ is a value of the kinematic viscosity at 100° C. of the mineral oil used in the dilution of the viscosity index improver.

The value of SSI of the viscosity index improver varies depending on the structure of polymers constituting the viscosity index improver, and specifically has the following tendency.

The more branched-chain polymers are than straight-chain polymers, the lower the value of SSI.

The higher the molecular weight of side chains of branched-chain polymers, the lower the value of SSI.

The more comb polymers are present than linear polymers, the lower the value of SSI.

[Other Viscosity Index Improvers]

The viscosity index improver to be used in one embodiment of the present invention may comprise viscosity index improvers composed of other polymers other than the above-mentioned comb polymers (A1) and (A2) in the range of not impairing the advantageous effects of the present invention.

Examples of such viscosity index improvers include polymers not corresponding to comb polymers, such as polymethacrylate, dispersed polymethacrylate, olefin copolymers (for example, ethylene-propylene copolymers), dispersed olefin copolymers, and styrene copolymers (for example, styrene-diene copolymers and styrene-isoprene copolymers).

In one embodiment of the present invention, however, it is preferable that the content of viscosity index improvers other than the comb polymers (A1) and (A2) is as low as possible.

Specifically, the total content of the other viscosity index improvers other than the comb polymers (A1) and (A2) in terms of resin content may be made to be, based on 100 parts by mass of the total in terms of resin content of the comb polymers (A1) and (A2), 100 parts by mass or less, 70 parts by mass or less, 50 parts by mass or less, 20 parts by mass or less, 10 parts by mass or less, 5 parts by mass or less, 1 part by mass or less, 0.1 part by mass or less, 0.01 part by mass or less, or 0.001 part by mass or less.

<Various Kinds of Additives>

The lubricating oil composition according to one embodiment of the present invention may comprise various kinds of additives in the range of not impairing the advantageous effects of the present invention.

Examples of such various kinds of additives include pour point depressants, antioxidants, metallic detergents, ashless dispersants, antiwear agents, rust inhibitors, deformers and extreme pressure additives.

These additives for lubricating oils may be used singly, or may be used concurrently in two or more kinds.

Each content of these various kinds of additives can be suitably adjusted in the range of not impairing the advantageous effects of the present invention, but is, based on the total amount (100 mass %) of the lubricating oil composition, independently, usually 0.001 to 15 mass %, preferably 0.005 to 10 mass % and more preferably 0.01 to 5 mass %.

As additives, there may be used a commercially available additive package containing a plurality of additives which complies with the standard by the European Automobile Manufacturer's Association (ACEA), the standards of API/ILSAC SN/GF-5, and the like.

Further, there may be used a compound (for example, a compound having functions as an antiwear agent and an extreme pressure additive) having multiple functions as the above additives.

These additives for lubricating oils may be used singly or may be used concurrently in two or more kinds.

[Pour Point Depressant]

The lubricating oil composition according to one embodiment of the present invention may further comprise a pour point depressant. The pour point depressant may be used singly or may be used concurrently in two or more kinds.

Examples of the pour point depressant to be used in one embodiment of the present invention include ethylene-vinyl acetate copolymers, condensates of chlorinated paraffin with naphthalene, condensates of chlorinated paraffin with phenol, polymethacrylates and polyalkylstyrenes.

The mass-average molecular weight (Mw) of the pour point depressant to be used in one embodiment of the present invention may be made to be 5,000 or more, 7.000 or more, 10,000 or more, 15,000 or more, 20,000 or more, 25,000 or more, 30,000 or more, 35,000 or more, 40,000 or more, 45,000 or more, 50,000 or more, 55,000 or more, or 60,000 or more, and then may be made to be 150,000 or less, 120,000 or less, 100,000 or less, 90,000 or less, or 80,000 or less.

[Antioxidant]

The lubricating oil composition according to one embodiment of the present invention may further comprise an antioxidant. The antioxidant may be used singly or may be used concurrently in two or more kinds.

Examples of the antioxidant to be used in one embodiment of the present invention include amine antioxidants such as alkylated diphenylamines, phenylnaphthylamine and alkylated phenylnaphthylamine; phenol antioxidants such as 2,6-di-t-butylphenol, 4,4'-methylenebis(2,6-di-t-butylphenol), isooctyl-3-(3,5-di-t-butyl-4-hydroxyphenyl) propionate, and n-octadecyl-3-(3,5-di-t-butyl-4-hydroxyphenyl) propionate; sulfur antioxidants such as phenothiazine, dioctadecyl sulfide, dilauryl-3,3'-thiodipropionate and 2-mercaptobenzimidazole; and the like.

[Metallic Detergent]

The lubricating oil composition according to one embodiment of the present invention may further comprise a metallic detergent. The metallic detergent may be used singly or may be used concurrently in two or more kinds.

The metallic detergent to be used in one embodiment of the present invention includes metal salts such as metal sulfonates, metal salicylates and metal phenates. Then, a metal atom constituting the metal salt is preferably a metal atom selected from alkali metals and alkaline earth metals, more preferably sodium, calcium, magnesium or barium, and still more preferably calcium.

In the lubricating oil composition according to one embodiment of the present invention, the metallic detergent preferably contains at least one or more selected from calcium sulfonate, calcium salicylate and calcium phenate, and more preferably contains calcium sulfonate.

The content rate of the calcium sulfonate is, based on the total amount (100 mass %) of the metallic detergent to be contained in the lubricating oil composition, preferably 50 to 100 mass %, more preferably 60 to 100 mass %, still more preferably 70 to 100 mass % and further still more preferably 80 to 100 mass %.

The base number of the metallic detergent is preferably 0 to 600 mgKOH/g.

In the lubricating oil composition according to one embodiment of the present invention, however, the metallic detergent is preferably an overbased metallic detergent having a base number of 100 mgKOH/g or larger.

The base number of the overbased metallic detergent is 100 mgKOH/g or larger, but is preferably 150 to 500 mgKOH/g and more preferably 200 to 450 mgKOH/g.

Then, in the present description, the "base number" means a base number by a perchloric acid method measured according to 7. of JIS K2501:2003 "Petroleum products and lubricants-Determination of neutralization number".

[Ashless Dispersant]

The lubricating oil composition according to one embodiment of the present invention may further comprise an ashless dispersant. The ashless dispersant may be used singly or may be used concurrently in two or more kinds.

The ashless dispersant to be used in one embodiment of the present invention is preferably an alkenyl succinic acid imide, and may also be a modified alkenyl succinic acid imide made by reacting an alkenyl succinic acid imide with at least one selected from boron compounds, alcohols, aldehydes, ketones, alkylphenols, cyclic carbonates, epoxy compounds, organic acids and the like.

[Antiwear Agent]

The lubricating oil composition according to one embodiment of the present invention may further comprise an antiwear agent. The antiwear agent may be used singly or may be used concurrently in two or more kinds.

Examples of the antiwear agent to be used in one embodiment of the present invention include sulfur- or phosphorus-containing antiwear agents including sulfur-containing compounds such as zinc dialkyldithiophosphate (ZnDTP), zinc phosphate, zinc dithiocarbamate, molybdenum dithiocarbamate, molybdenum dithiophosphate, disulfides, olefin sulfides, sulfurized fats and oils, sulfurized esters, thiocarbonates, thiocarbamates and polysulfides; phosphorus-containing compounds such as phosphite esters, phosphate esters, phosphonate esters, and amine salts or metal salts of these; and thiophosphite esters, thiophosphate esters, thiophosphonate esters, and amine salts or metal salts of these.

[Rust Inhibitor]

The lubricating oil composition according to one embodiment of the present invention may further comprise a rust inhibitor. The rust inhibitor may be used singly or may be used concurrently in two or more kinds.

Examples of the rust inhibitor to be used in one embodiment of the present invention include fatty acids, alkenyl succinic acid half esters, fatty acid soaps, alkylsulfonate salts, polyhydric alcohol fatty acid esters, fatty acid amines, oxidized paraffins and alkyl polyoxyethylene ethers.

[Defoamer]

The lubricating oil composition according to one embodiment of the present invention may further comprise a defoamer. The defoamer may be used singly or may be used concurrently in two or more kinds.

Examples of the defoamer to be used in one embodiment of the present invention include alkylsilicone defoamers, fluorosilicone defoamers and fluoroalkyl ether defoamers.

[Extreme Pressure Additive]

The lubricating oil composition according to one embodiment of the present invention may further comprise an extreme pressure additive. The extreme pressure additive may be used singly or may be used concurrently in two or more kinds.

Examples of the extreme pressure additive to be used in one embodiment of the present invention include chlorine extreme pressure additives such as chlorinated paraffins, chlorinated fatty acids and chlorinated fatty oils; sulfur extreme pressure additives such as sulfurized olefins, sulfurized lard, alkyl polysulfides and sulfurized fatty acids; phosphorus extreme pressure additives such as phosphate esters, phosphite esters, thiophosphate esters, and salts of these, phosphine ones and tricresyl phosphate; and the like.

<Method for Producing the Lubricating Oil Composition>

A method for producing the lubricating oil composition according to one embodiment of the present invention is not especially limited, and is preferably a method comprising a step of blending the above-mentioned viscosity index improver and as required, other various additives in the base oil. The order of blending each component can suitably be established.

[Properties of the Lubricating Oil Composition]

The kinematic viscosity at 100° C. of the lubricating oil composition according to one embodiment of the present invention is preferably 9.3 $mm^2/s$ or more, more preferably 9.4 $mm^2/s$ or more and still more preferably 9.5 $mm^2/s$ or more, and preferably 10.0 $mm^2/s$ or less and more preferably 9.9 $mm^2/s$ or less.

The kinematic viscosity at 40° C. of the lubricating oil composition according to one embodiment of the present invention is preferably 38.0 $mm^2/s$ or less, more preferably 37.8 $mm^2/s$ or less, still more preferably 37.6 $mm^2/s$ or less, further still more preferably 37.4 $mm^2/s$ or less, further still more preferably 37.2 $mm^2/s$ or less, further still more preferably 37.0 $mm^2/s$ or less, further still more preferably 36.8 $mm^2/s$ or less, further still more preferably 36.6 $mm^2/s$ or less, further still more preferably 36.4 $mm^2/s$ or less and especially preferably 36.2 $mm^2/s$ or less.

The viscosity index of the lubricating oil composition according to one embodiment of the present invention is preferably 170 or more, more preferably 180 or more, still more preferably 190 or more, further still more preferably 200 or more, further still more preferably 210 or more, further still more preferably 220 or more, further still more preferably 230 or more, further still more preferably 240 or more, further still more preferably 250 or more, further still more preferably 260 or more and especially preferably 270 or more.

The HTHS viscosity at 150° C. of the lubricating oil composition according to one embodiment of the present invention is preferably 2.9 to 3.0 mPa·s.

Here, in the present description, the HTHS viscosity of the lubricating oil composition means a value of the viscosity after shearing at a shear rate of 106/s according to ASTM D4683.

In the lubricating oil composition according to one embodiment of the present invention, the kinematic viscosity at 100° C. (hereinafter, for convenience, referred to also as "Bosch 100° C. kinematic viscosity") of the lubricating oil composition after being passed through a 30-cycle high-shear Bosch diesel injector based on ASTM D6278 is preferably 8.6 $mm^2/s$ or more, more preferably 8.7 $mm^2/s$ or more, still more preferably 8.8 $mm^2/s$ or more, further still more preferably 8.9 $mm^2/s$ or more, further still more preferably 9.0 $mm^2/s$ or more, further still more preferably 9.1 $mm^2/s$ or more and especially preferably 9.2 $mm^2/s$ or more, and then preferably less than 10.5 $mm^2/s$, more preferably 10.4 $mm^2/s$ or less, still more preferably 10.3 $mm^2/s$ or less, further still more preferably 10.2 $mm^2/s$ or less, further still more preferably 10.1 $mm^2/s$ or less and especially preferably 10.0 $mm^2/s$ or less.

The sulfuric ash content of the lubricating oil composition according to one embodiment of the present invention is preferably 0.90 mass % or less, more preferably 0.88 mass % or less, still more preferably 0.86 mass % or less, further still more preferably 0.84 mass % or less, further still more preferably 0.82 mass % or less and especially preferably 0.80 mass % or less.

Further, the sulfuric ash content is preferably 0.61 mass % or more, more preferably 0.65 mass % or more and still more preferably 0.70 mass % or more.

Then, in the present description, the sulfuric ash content means a value measured or calculated according to ASTM D874.

[Applications of the Lubricating Oil Composition]

The lubricating oil composition of the present invention has excellent fuel consumption saving performance and high shear stability. Hence, engines having the lubricating oil composition of the present invention filled therein can become excellent in the fuel consumption saving performance and the like. The lubricating oil composition of the present invention can be used suitably for diesel engines.

Hence, the present invention also provides a diesel engine of the following [I] and a method for using the lubricating oil composition of the following [II].

[I] A diesel engine comprising the lubricating oil composition according to one embodiment of the present invention filled therein.

[II] A method for using a lubricating oil composition, wherein the above-mentioned lubricating oil composition according to one embodiment of the present invention is applied to lubrication of a diesel engine.

EXAMPLES

Then, the present invention will be described in more detail by way of Examples, but the present invention is not any more limited to these Examples. Here, various physical properties of each component used in Examples, Comparative Examples and Reference Example and obtained lubricating oil compositions were measured according to the following methods.

<Kinematic Viscosity>

The kinematic viscosity was measured and calculated according to ASTM D455.

<Viscosity Index>

The viscosity index was measured and calculated according to ASTM D2270.

<SSI (Shear Stability Index)>

The shear stability index was measured and calculated according to ASTM D6278.

<Weight-Average Molecular Weight (Mw), Number-Average Molecular Weight (Mn)>

The weight-average molecular weight (Mw) and the number-average molecular weight (Mn) were measured and calculated by carrying out measurement by using a gel permeation chromatography device ("1260-type HPLC", manufactured by Agilent Technologies, Inc.) under the following condition and using values measured in terms of standard polystyrenes.

(Measurement Condition)

Column: two columns of "Shodex LF404" successively connected

Column temperature: 35° C.

Development solvent: chloroform

Flow rate: 0.3 mL/min

<HTHS Viscosity>

The viscosity after shearing at a measurement temperature of 150° C. at a shear rate of 106/s was measured.

<Bosch 100° C. Kinematic Viscosity>

There was measured the kinematic viscosity at 100° C. after being passed through a 30-cycle high-shear Bosch diesel injector according to ASTM D6278.

<Sulfuric Ash Content>

The sulfuric ash content was measured according to ASTM D874.

Examples 1 to 4, Comparative Examples 1 to 6, and Reference Example 1

Various components and other additives indicated in Table 1 were added and mixed in blend amounts indicated in Table 1 to thereby prepare lubricating oil compositions, respectively. Here, the blend amounts of viscosity index improvers are described as blend amounts in terms of resin content excluding diluting solvent. The detail of each component used in preparation of the lubricating oil compositions were as follows.

<Base Oil>

Mineral oil: a mineral oil classified in Group III of the API base oil category, having a 100° C. kinematic viscosity of 4.3 $mm^2/s$ and a viscosity index of 124

<Viscosity Index Improvers>

Comb polymer (A1): a comb polymer having a structure having, on a main chain, a large number of three-way branch points from which high-molecular weight side chains extend, Mw: 260,000, Mw/Mn: 3.1, SSI: 1

Comb polymer (A2): a comb polymer having a structure having, on a main chain, a large number of three-way branch points from which high-molecular weight side chains extend, Mw: 450,000, Mw/Mn: 5.5, SSI: 9

PMA (1): a polymethacrylate, Mw: 540,000, SSI: 50

PMA (2): a polymethacrylate, Mw: 230,000, SSI: 25

PMA (3): a polymethacrylate, Mw: 430,000, SSI: 20

<Other Additives>

An additive mixture made by mixing a detergent, a dispersant, ZnDTP, a defoamer, a pour point depressor, molybdenum dithiocarbamate (MoDTC), benzotriazole and diethanolamide.

For the lubricating oil compositions prepared in Examples, Comparative Examples and Reference Example, the various physical properties were measured and calculated according to the above-mentioned measurement methods. The results thereof are shown in Table 1. Here, the case where there was even one property among the various physical properties out of the following corresponding range was taken as "unacceptable"; and the case where all the physical properties were within the following corresponding ranges was taken as "acceptable".

40° C. kinematic viscosity: 38.0 $mm^2/s$ or less

100° C. kinematic viscosity: 9.3 $mm^2/s$ or more, 10.0 $mm^2/s$ or less

HTHS viscosity (150° C.): higher than 2.8 mPa·s, 3.0 mPa·s or less

Bosch 100° C. kinematic viscosity: 8.6 $mm^2/s$ or more

TABLE 1

| | | | Reference Example | Example 1 | Example 2 | Example 3 | Example 4 | Comparative Example 1 |
|---|---|---|---|---|---|---|---|---|
| Composition of lubricating oil composition | | | | | | | | |
| Base oil | mineral of (100N) | mass % | 87.6 | 87.7 | 87.5 | 87.6 | 87.4 | 87.6 |
| Viscosity index improver | PMA(1) | mass % | 0.45 | | | | | |
| | PMA(2) | mass % | 1.24 | | | | | |
| | PMA(3) | mass % | 0.80 | | | | | |
| | comb polymer (A1) | mass % | | 0.57 | 0.57 | 0.64 | 0.84 | 0.00 |
| | comb polymer (A2) | mass % | | 1.87 | 2.03 | 1.87 | 1.87 | 2.49 |
| Other additives | | mass % | 9.90 | 8.90 | 9.90 | 9.90 | 9.90 | 9.90 |
| Total | | mass % | 100.00 | 100.00 | 100.00 | 100.00 | 100.00 | 100.00 |
| Content ratio (mass ratio of comb polymer (A1)/comb polymer (A2) | | — | | 0.30 | 0.28 | 0.34 | 0.45 | 0.00 |
| Properties of lubricating oil composition | | | | | | | | |
| Kinematic viscosity | 40° C. | $mm^2/s$ | 43.0 | 35.3 | 38.2 | 35.5 | 36.1 | 37.0 |
| | 100° C. | $mm^2/s$ | 9.4 | 9.5 | 9.9 | 9.6 | 9.9 | 10.2 |
| HTHS viscosity | 150° C. | mPa · s | 2.9 | 2.9 | 3.0 | 2.9 | 3.0 | 2.9 |
| Bosch kinematic viscosity | 100° C. | $mm^2/s$ | 8.6 | 9.2 | 9.5 | 9.3 | 9.5 | 9.7 |
| Viscosity index | | — | 210 | 271 | 278 | 273 | 279 | 282 |
| Sulfuric ash content | | mass % | 0.73 | 0.75 | 0.73 | 0.77 | 0.75 | 0.74 |
| Acceptance/Rejection | | | unacceptable | acceptable | acceptable | acceptable | acceptable | unacceptable |

| | | | Comparative Example 2 | Comparative Example 3 | Comparative Example 4 | Comparative Example 5 | Comparative Example 6 |
|---|---|---|---|---|---|---|---|
| Composition of lubricating oil composition | | | | | | | |
| Base oil | mineral of (100N) | mass % | 88.2 | 89.5 | 87.9 | 87.0 | 86.4 |
| Viscosity index improver | PMA(1) | mass % | | | | | |
| | PMA(2) | mass % | | | | | |
| | PMA(3) | mass % | | | | | |
| | comb polymer (A1) | mass % | 0.00 | 0.57 | 0.34 | 0.57 | 3.70 |
| | comb polymer (A2) | mass % | 1.87 | 0.00 | 1.87 | 2.49 | 0.00 |
| Other additives | | mass % | 9.90 | 9.90 | 9.90 | 9.90 | 9.90 |
| Total | | mass % | 100.00 | 100.00 | 100.00 | 100.00 | 100.00 |
| Content ratio (mass ratio of comb polymer (A1)/comb polymer (A2) | | — | 0.00 | — | 0.18 | 0.23 | — |
| Properties of lubricating oil composition | | | | | | | |
| Kinematic viscosity | 40° C. | $mm^2/s$ | 33.7 | 28.0 | 34.6 | 39.0 | 349 |
| | 100° C. | $mm^2/s$ | 8.8 | 5.9 | 9.2 | 11.2 | 9.8 |
| HTHS viscosity | 150° C. | mPa · s | 2.8 | 2.2 | 2.8 | 3.2 | 3.5 |
| Bosch kinematic viscosity | 100° C. | $mm^2/s$ | 8.5 | 5.8 | 8.9 | 10.5 | 9.7 |
| Viscosity index | | — | 257 | 163 | 286 | 294 | 268 |
| Sulfuric ash content | | mass % | 0.74 | 0.73 | 0.75 | 0.76 | 0.77 |
| Acceptance/Rejection | | | unacceptable | unacceptable | unacceptable | unacceptable | unacceptable |

From Table 1, it is shown that the lubricating oil compositions of Examples 1 to 4, which had content ratios (mass ratios) of the comb polymers (A1) and (A2) of predetermined numerical values or more, exhibited all the various physical properties in predetermined ranges. It can be said that the lubricating oil compositions having such properties had excellent fuel consumption saving performance and high shear stability.

The invention claimed is:

1. A lubricating oil composition, comprising:

a base oil;

a comb polymer (A1) having a weight-average molecular weight, Mw, of less than 300,000 and a ratio of weight-average molecular weight to number average molecular weight, Mw/Mn, of 4.00 or less; and a comb polymer (A2) having a Mw of 400,000 or more and a Mw/Mn of 6.00 or less, wherein a mass content ratio A1/A2 in terms of resin content mass between the comb polymer (A1) and the comb polymer (A2) is in a range of 0.25 to 0.55.

2. The lubricating oil composition of claim 1, wherein the comb polymer (A1), in terms of resin content, is in a range of from 0.01 to 3.50 mass %, based on the total lubricating oil composition mass.

3. The lubricating oil composition of claim 1, wherein the comb polymer (A2), in terms of resin content, is in a range of from 0.01 to 2.40 mass %, based on the total lubricating oil composition mass.

4. The lubricating oil composition of claim 1, wherein the lubricating oil composition has a kinematic viscosity of 9.3 $mm^2/s$ or more at 100° C.

5. The lubricating oil composition of claim 1, wherein the lubricating oil composition has a high-temperature high-shear viscosity of 2.9 mPa·s or more at 150° C.

6. The lubricating oil composition of claim 1, wherein the lubricating oil composition has a kinematic viscosity of 38.0 $mm^2/s$ or less at 40° C.

7. The lubricating oil composition of claim 1, wherein the lubricating oil composition has a kinematic viscosity of 8.6 $mm^2/s$ or more at 100° C. based on ASTM D6278 after being passed through a 30-cycle high-shear Bosch diesel injector.

8. The lubricating oil composition of claim 1, wherein the lubricating oil composition has a sulfuric ash content of 0.90 mass % or less.

9. The lubricating oil composition of claim 1, wherein the lubricating oil composition is formulated for a diesel engine.

10. A diesel engine, comprising:

the lubricating oil composition of claim 1 filled therein.

11. A method for using a lubricating oil composition, comprising:

lubricating a diesel engine with the lubricating oil composition of claim 1.

12. The lubricating oil composition of claim 1, wherein the comb polymer (A1) is in a range of from 0.01 to 3.50 mass % in terms of resin content based on the total lubricating oil composition mass, and the comb polymer (A2) is in a range of from 0.01 to 2.40 mass % in terms of resin content based on the total lubricating oil composition mass.

13. The lubricating oil composition of claim 1, wherein the comb polymer (A1) is in a range of from 0.01 to 3.50 mass % in terms of resin content based on the total lubricating oil composition mass, the comb polymer (A2) is in a range of from 0.01 to 2.40 mass % in terms of resin content based on the total lubricating oil composition mass, and the lubricating oil composition has a kinematic viscosity at of 9.3 $mm^2/s$ or more at 100° C.

14. The lubricating oil composition of claim 1, wherein the comb polymer (A1) in a range of from 0.01 to 3.50 mass %, the comb polymer (A2) is in a range of from 0.01 to 2.40 mass %, the lubricating oil composition has a kinematic viscosity of 9.3 $mm^2/s$ or more at 100° C., and the lubricating oil composition has a kinematic viscosity of 38.0 $mm^2/s$ or less at 40° C.

* * * * *